United States Patent [19]

Sheppard et al.

[11] Patent Number: 4,494,250

[45] Date of Patent: Jan. 22, 1985

[54] MODIFIED ANGLE, BIAS CROTCH, FRONT POCKET PANTS

[76] Inventors: Mark T. Sheppard; Lynda J. Timbers, both of 105 E St., Roseville, Calif. 95678

[21] Appl. No.: 501,604

[22] Filed: Jun. 6, 1983

[51] Int. Cl.[3] ..... A41D 1/06

[52] U.S. Cl. ..... 2/227; 2/243 R

[58] Field of Search ..... 2/243 R, 243 B, 227, 2/238, 228, 403

[56] References Cited

U.S. PATENT DOCUMENTS

| | | | |
|---|---|---|---|
| 478,281 | 7/1892 | Hamilton et al. | 2/227 |
| 707,556 | 8/1902 | Dane | 2/227 |
| 1,766,697 | 6/1930 | Stein | 2/227 |
| 2,264,472 | 12/1941 | Hicks | 2/227 |

*Primary Examiner*—H. Hampton Hunter

*Attorney, Agent, or Firm*—Mark C. Jacobs

[57] ABSTRACT

An improvement in human outergarments, specifically pants, adapted to relieve the tension in the rear central vertical seams thereof by the incorporation of a pair of modified bias front seams such that the tension is relieved along the natural lines of the body. The improved garments suitable for both men and women.

13 Claims, 21 Drawing Figures

MODIFIED ANGLE, BIAS CROTCH, FRONT POCKET PANTS

BACKGROUND OF THE INVENTION

In recent years the trend in men's pants has been the lean, European look, with less bulk. Women have also gone for the tight fitting pants that accent body lines. Even teenagers of both sexes many times tend to buy pants, especially jeans, 1 or 2 sizes too small such that they will fit tightly. While this may seem sexy, pants using the conventional four (4) panel construction have been known to split along the vertical seams, even when reinforced, due to tension placed on the seams from sitting, bending, and other body movements. There has been a need, therefore, for a new type of pants construction that is more resistant to tearing both along the seams and in the panels themselves, which construction will relieve the tension and therefore not give rise to seam rippage.

This invention relates to outer garments of the genus of trousers (pants) such as slacks, Jamaica and Bermuda shorts, jeans, and the like.

It is an object of this invention to provide a novel construction for the manufacture of pants of all types.

It is another object to provide pants that have modified front bias seams.

It is yet another object to provide pants, both long and short, that relieve the strain on the rear seam of conventionally constructed pants to prevent seam rippage.

It is still another object to provide unisex pants that are comfortable for both men and women of all ages.

In reviewing the prior art, applicant is aware of the following U.S. patents:

U.S. Pat. No. 1,810,517, Fink;
U.S. Pat. No. 1,592,732, Friedman;
U.S. Pat. No. 1,740,554, Trageser;
U.S. Pat. No. 2,2242,526, Kniedler;
U.S. Pat. No. 3,246,331, Paolucci.

Other objects of the invention will in part be obvious and will in part appear hereinafter.

The invention accordingly comprises the product possessing the features, properties and the relation of components which are exemplified in the following detailed disclosure, and the scope of the application of which will be indicated in the claims.

For a fuller understanding of the nature and objects of the invention, reference should be made to the following detailed description taken in connection with the accompanying drawings.

SUMMARY OF THE INVENTION

The invention pertains to a novel construction for pants utilizing a modified bias in the crotch area to obtain a flounced zone of no stress formed from the overlay of inner and outer panels on both the right and left sides of the garment front. Pockets are formed for the garment as a result of the overlay and stitching.

DESCRIPTION OF THE PREFERRED EMBODIMENT

In the description set forth herein like numbers shall refer to like parts in the several views.

Figure 17:
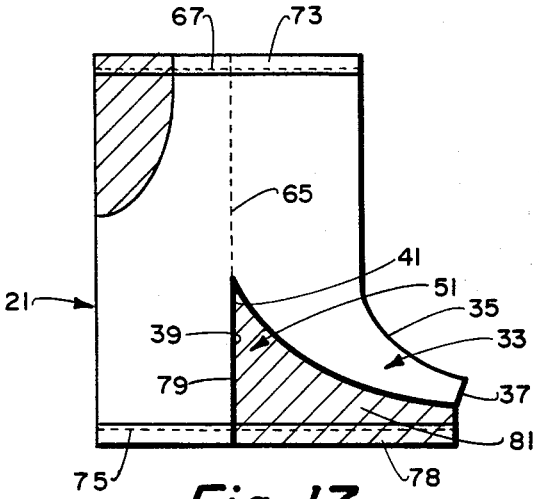
FIG. 17 is a front view of panel 15 overlaid and sewn into place on panel 13 according to the invention.

The pants of this invention are constructed by overlaying a pair of front inner and front outer panels each cut and configured as particularly described herein and sewing certain of the edges together to achieve a flounced zone of no stress and at the same time forming the pockets for the pants. The overlay construction of the left front half of the pants is shown in FIG. 17, while the individual four (4) panels utilized for the front of the pants, shorts or long pants are seen in FIGS. 6,7,11 and 12.

Figure 13:
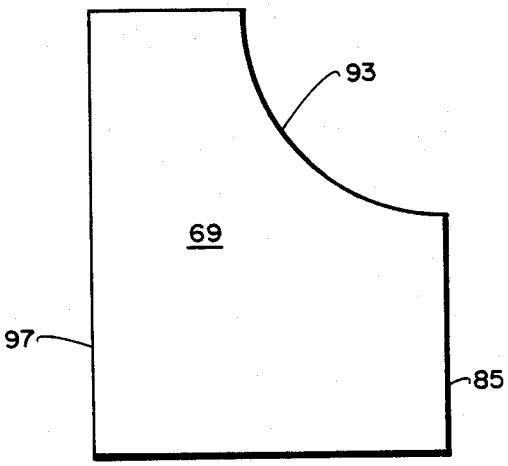
FIGS. 13 and 14 are the conventional rear left and right panels employed herein.
Figure 14:
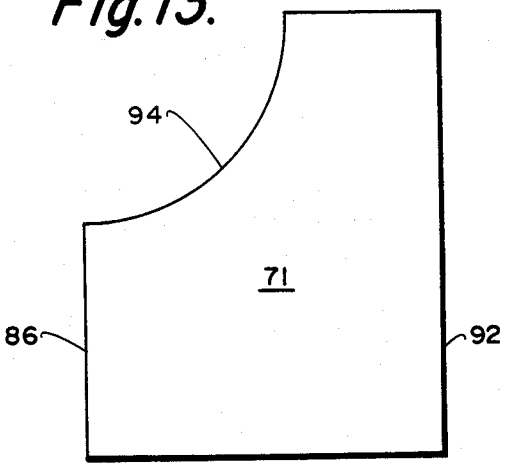
Figure 6:
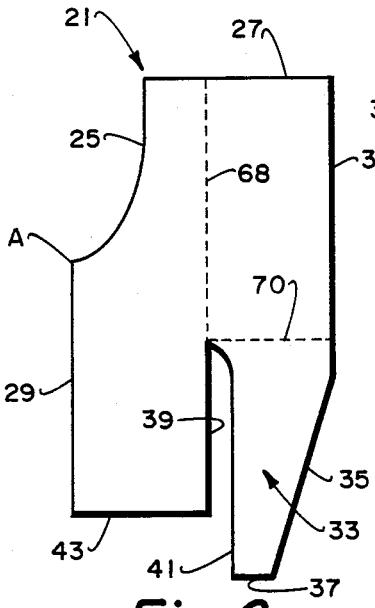
FIGS. 6 and 7 are elevational views of the outer front left and right panels of the improved pants of this invention, featuring jean (western) pockets.
Figure 7:
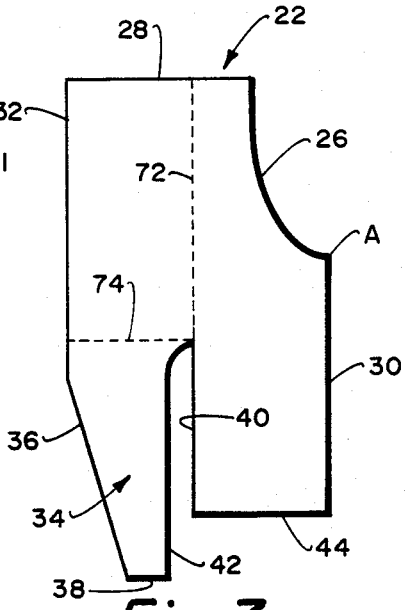

The garment is formed from four (4) main sections namely the left and right front and rear sections. The rear is comprised of two (2) conventional panels 69 and 71, seen in FIGS. 13 and 14 respectively. The front sections are mirror image sections, save for slight differences in the fly front, if such is employed, the differences not affecting the inventive aspect herein. One of the front sections, the left one. is shown in FIG. 17. It is comprised of a front outer left panel 21, depicted in FIG. 6, and a front inner left panel 51 shown in FIG. 11. The corresponding outer and inner panels for the right side are shown in FIGS. 7 and 12 respectively.

In most instances, fabric is preferably folded over slightly at the edge in order to avoid raw edges, as is known in the art to seamstresses. For the purpose of this discussion, no distinction will be drawn between rough and smooth edges, and only the term edge will be employed. Folded over or smooth edges, where applicable are contemplated herein.

While only one overlaid half is shown for the front, the discussion will pertain to both individual panels that comprise the front section, but reference will be made to only one side of the total front, namely the left side. The discussion is seen to be equally applicable for the right side as well.

Figure 11:
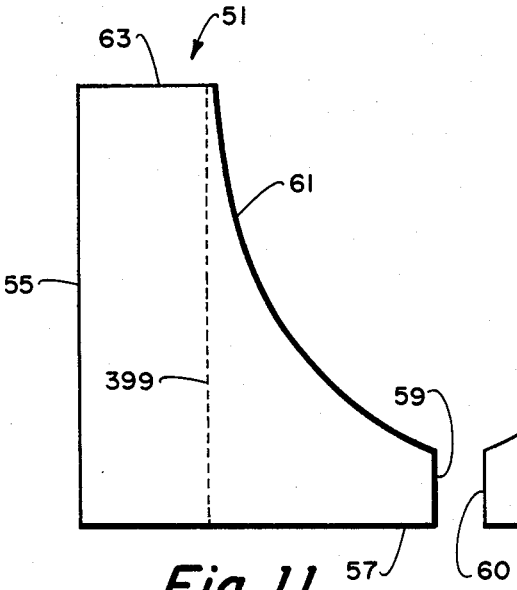
FIGS. 11 and 12 are elevational views of the inner front left and right panels of the pants of this construction.
Figure 12:
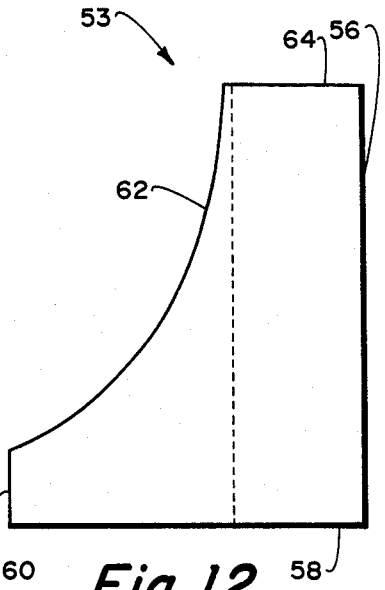

The top edges 27, 28 of panel 21, 22, respectively, are lined up with the top edges 63, 64, respectively, of panel 51, 53, respectively as seen in FIGS. 11 and 12. These are folded over together and seamed along seam 67 to form a waistband area, per FIG. 17. The folded over portion 73 per FIG. 17 can include or exclude an elastic or other stiffener as is known in the art depending upon the nature of the waist to be employed, i.e. belted or flexible.

Pocket edge 25, 26 is left unattached. Here the pocket edges are slightly arcuate, a style employed in blue jeans and other western style pants and shorts.

Lower vertical edge 29, 30 are overlaid and sewn to outer edges 55 and 56 of the inner panels 51, 53 respectively. For the sake of brevity reference will now only be made to the panels 6 and 11, it being understood that the discussion is equally applicable to the corresponding right side panels 7 and 12, which have even numbered designators corresponding to the designators employed for the front left side, wherein the odd number of the left side's edge is increased by one (1) to create the even numbered designator for the front right side. Such designators are shown in the drawings.

Continuing on with the discussion of the left front section, per FIG. 17, bottom edges 43 and 57 are folded over and seamed together along the cross seam 75 as seen in FIG. 17. Reference at this time should be had to FIG. 3 wherein long pants 10 are shown. Here, the two bottom edges 43 and 57 are not folded over, but merely sewed together at cross seam 75A. The fold is used as previously discussed to form the bottom of the shorts 20 seen in FIG. 4. Pocket limiting edge 39, seen in both FIG. 6 and FIG. 17, is sewn to the underlaid inner panel along seam 79. Dotted line 399 (FIG. 11) represents the line along which the seam 79 and seam 65 define the pocket. The line 399 thus includes seam 79 to join the visible areas of the inner and outer panels, and seam 65 which merely binds the outer layer to the inner layer (the crosshatched layer) of FIG. 17 to thereby define the pocket.

Figure 15:
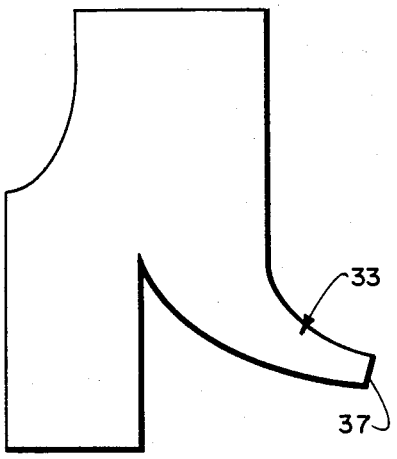
FIGS. 15 and 16 are front views of panels 6 and 7 as seen positioned after being sewn in place.
Figure 16:
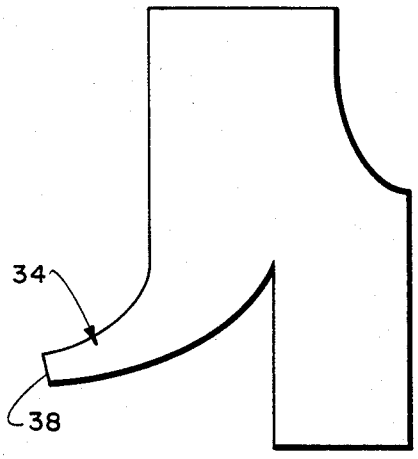

Panel 21 is seen to include as a contiguous portion thereof front center portion 33 having inner-outer edge 41, front-back forming edge 37 and front center seam edge 35. These parts of portion 33 are seen in FIG. 6 as they and the balance of panel 21 is cut from a square of fabric. The counterpart thereof is shown in FIG. 7. If reference is made to FIGS. 15 and 16, one sees how the portion 33 is stretched arcuately for actual utilization. Its compatriot is shown in its use position in FIG. 16. Reference is now made to FIG. 17 which shows the overlay of panel 21, and especially portion 33, on panel 51.

Portion 33 is sewn to the underpanel 51 along edge 41 and front-back forming edge 37. The front center seam edge 35 is turned in an arc so it can be joined by a french or hidden seam to the corresponding edge on its mirror image panel, namely edge 36 (FIG. 7) along seam 83 seen in FIG. 3.

Figure 1:
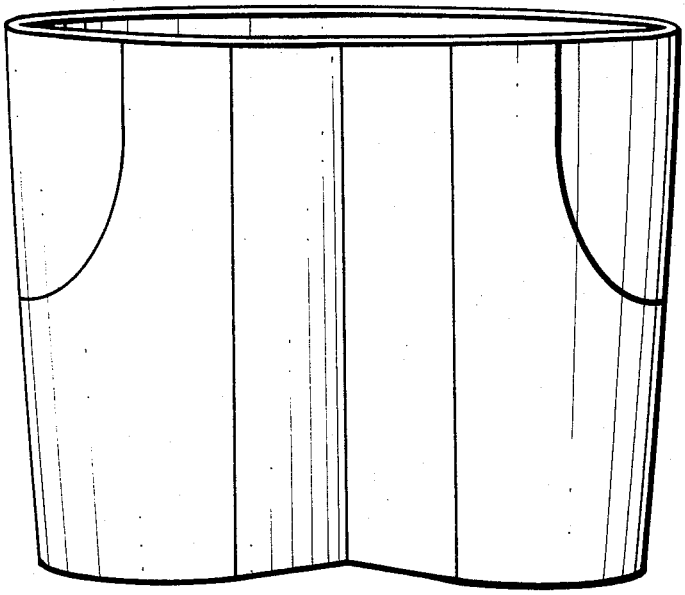
Fig. 1. (PRIOR ART)
FIG. 1 is a front elevational view of conventionally constructed shorts with jean pockets, and no fly, Prior art.
Figure 2:
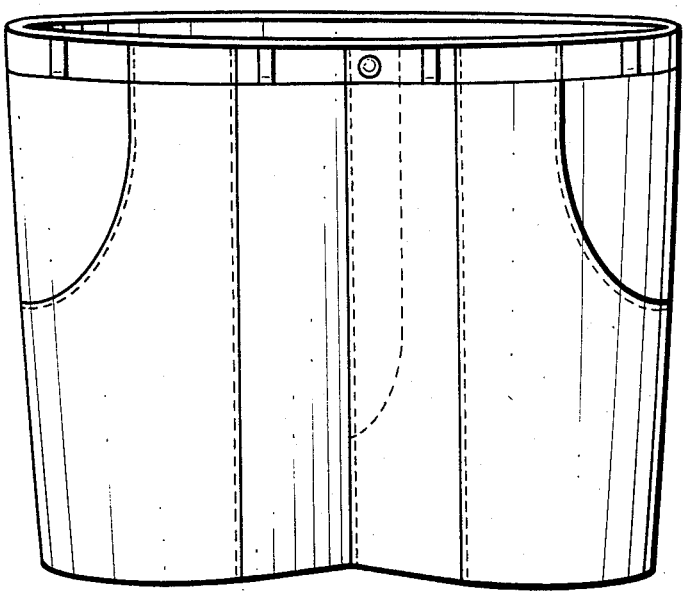
Fig. 2. (PRIOR ART)
FIG. 2 is a front elevational view of conventional jean pocket shorts to be worn with a belt, and having a fly front. Prior art.
Figure 3:
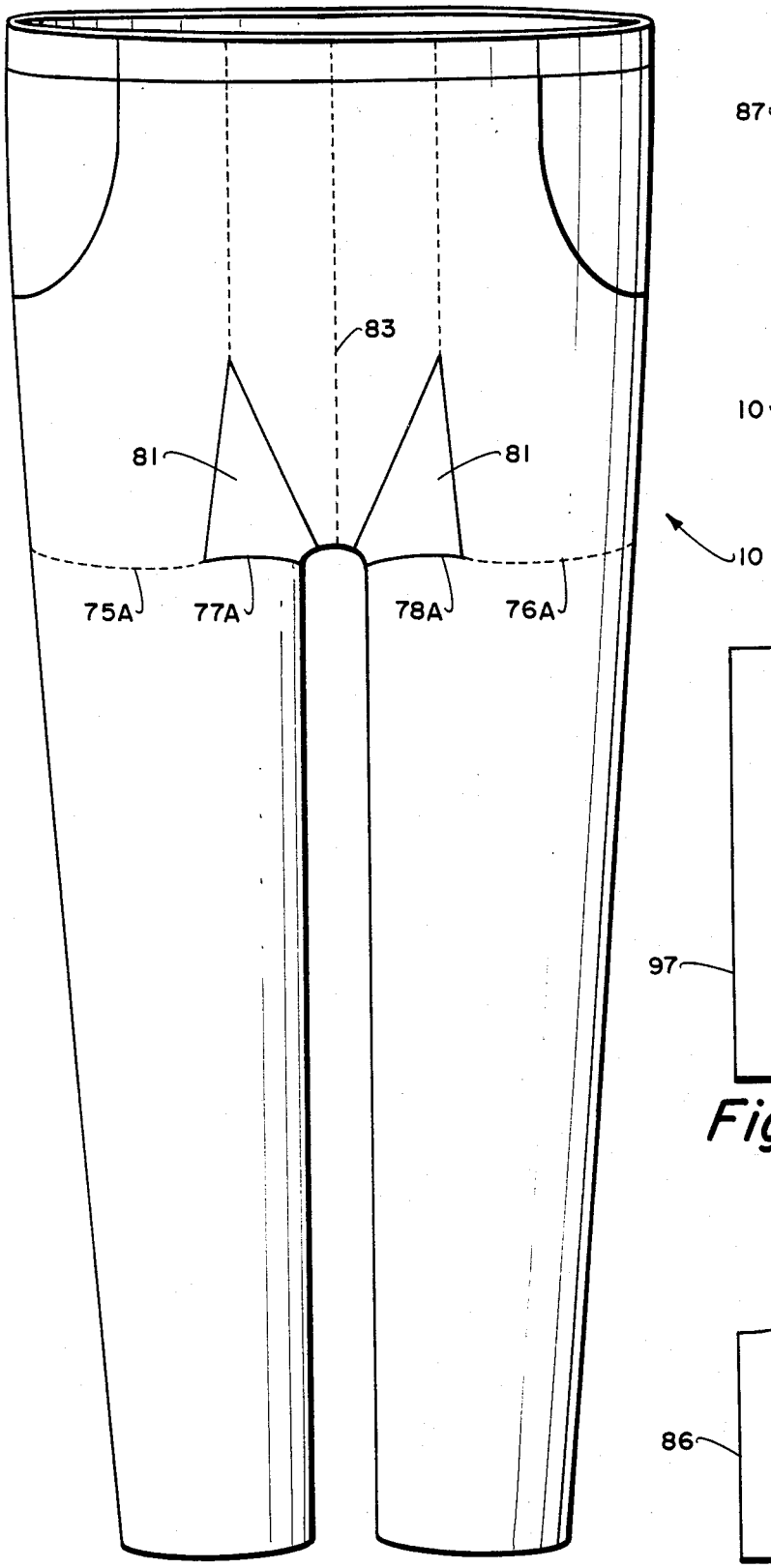
FIG. 3 is a front slightly perspective view of pants constructed according to this invention.
Figure 4:
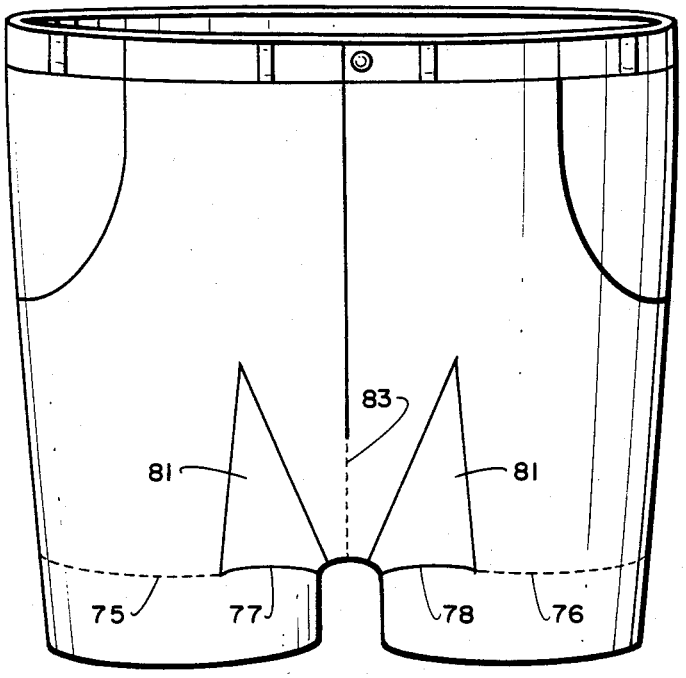
FIG. 4 is a front slightly perspective view of belt type shorts according to this invention.

Since more fabric is present, the portion 81 of panel 51 puckers and becomes flounced and sort of "baggy". This bagginess is best seen in FIGS. 3 and 4. The fullness created brings the fabric away from the body, such that upon bending, no strain is placed on the fabric in the area where the two legs each join the torso.

If desired, seam 83 can extend upwardly only partially rather than the full distance from crotch to waistline, if a fly front is desired for the pants. In such instance the edges 31 and 32 instead of being joined together would be finished off and a zipper, not seen, applied to edge 31 in conventional fashion. Such pants are depicted in FIG. 4.

The back of the pants is comprised of conventionally configured panels 69 and 71 (FIGS. 13 and 14) which are sewn in place in conventional fashion along edges 85, 86 to each other, as well as edges 59 and 60 and 37 and 38, all in one straight line to create the seam defining the line of separation of the front from the back of the pants, i.e. the seat. The rear panels are also seamed to panels 51 and 53 (See FIG. 12) along edges 55 and 56, respectively, to 92 and 97; and these rear panels are sewed also along edges 93 and 94 to form the vertical rear seam 95 seen in FIG. 5.

Figure 5:
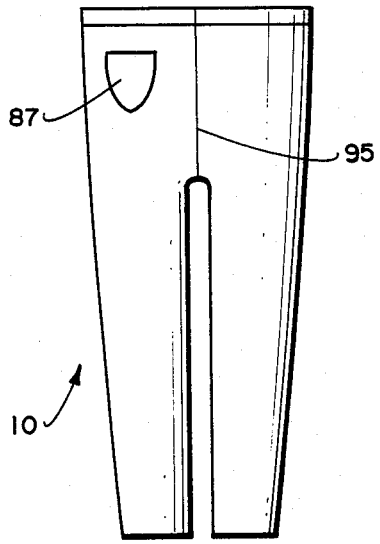
FIG. 5 is a rear view of pants made by standard construction techniques. The pocket shown has no bearing on the construction employed and is for illustration only.

If desired, a rear pocket 87—conventional—may be added as shown in the rear view of FIG. 5.

Figure 9:
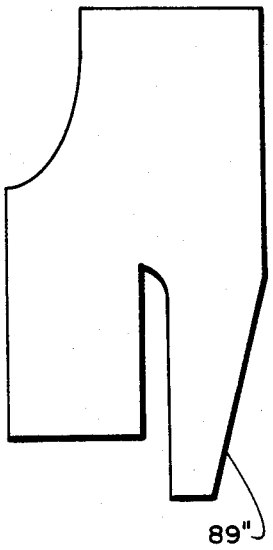
FIG. 9 is a variant of the edge of the panel portion shown in FIG. 8.
Figure 8:
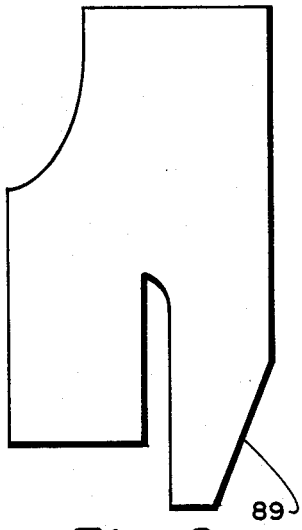
FIG. 8 is a partial view of the panel of FIG. 6.

Turning now to FIGS. 8 and 9, it is seen that the angle 89 that gives rise to the length of front center seam edge 35 and 36 can vary such as to control the length of edge 35 and 36. Thus angle 89 which is greater than angle 89'' seen in FIGS. 9 and 8, respectively, affects the size of the pouch or flounce formed in portion 81. The smaller the angle 89, the longer the edge 35, the less full the pouch. Reference is again made to FIGS. 9 and 8.

Figure 10:
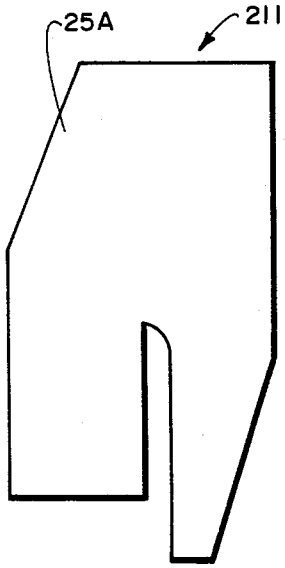
FIG. 10 is an elevational view of a panel similar to that shown in FIG. 6, but with slash pockets.

While panel 21 as shown in FIG. 6 as having an arcuate or jean type pocket edge 25, it is seen that the front outer panel can be configured along the lines of panel 211 in FIG. 10 having a pocket forming edge 25A to create slash pockets, the variety found usually in dress trousers for men.

Figure 18:
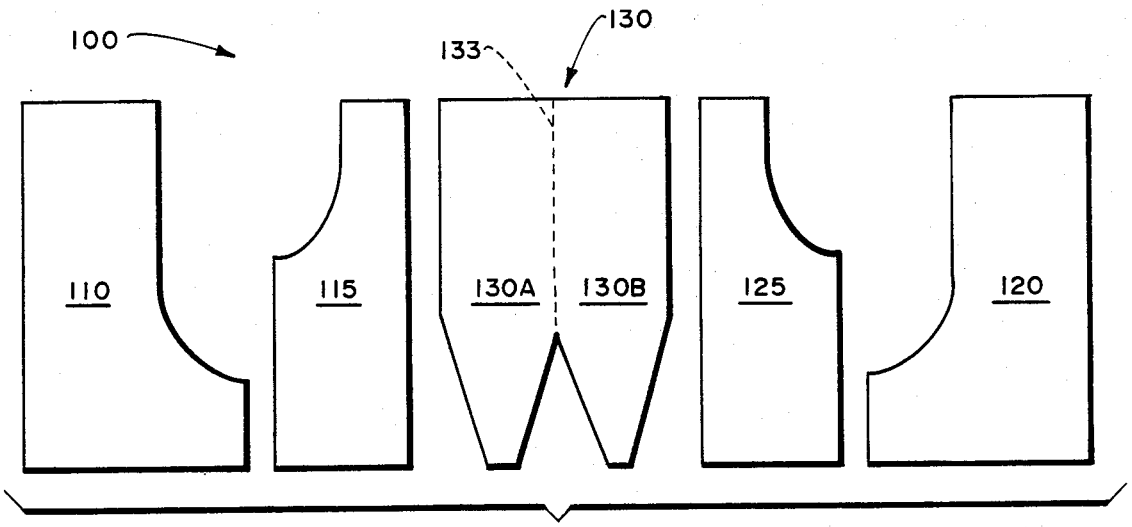
FIG. 18 is a front elevational view of the several panels employed in a variant form of this invention.

Turning now to FIG. 18, it is seen that while previously four (4) panels, two (2) inner and two (2) outer were employed for the formation of the front of the unique pants of this invention, this figure illustrates a variant wherein five (5) panels are employed, two (2) outer and three (3) inner. The balance of the pants are formed in like manner to those previously discussed.

Figure 20:
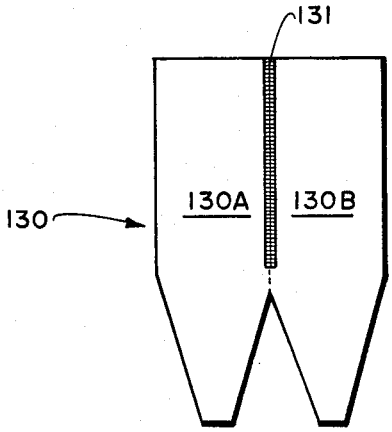
FIG. 20 is an elevational view of a variant of one of the panels shown in FIG. 18.

Here the front of the pants 100 is constructed not of four (4) but of five (5) panels. They are 110, the left inner panel, 115 the left outer panel, 120 the right inner panel, 125 right outer panel and 130 the central panel. Central panel 130 may be employed as shown, or it can include a zipper or snaps 131 as shown in the variant form of this panel at FIG. 20. It is seen that the central panel 130 actually constitutes the portions 33 and 34 of panels 21 and 23 respectively taken in conjunction with those portions of panels 21 and 23 defined by the dotted lines 68,70, and 72,74 which are abutting portions 33 and 34 respectively. Reference is again made to FIGS. 6 and 7.

Figure 19:
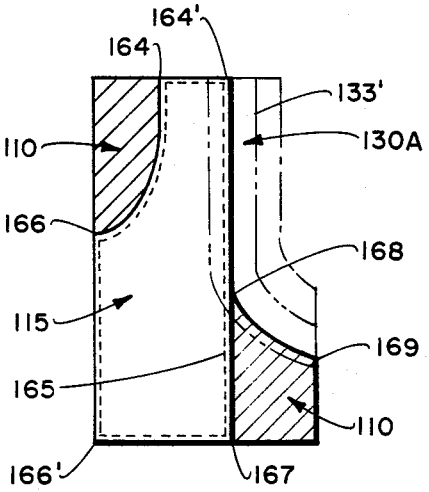
FIG. 19 is a front view of some of the panels of FIG. 18 overlaid and sewn into place.

The overlaying of panel 115 onto panel 110 for sewing thereupon and the attachment of central panel 130 to form the entire left side of a pair of Bermuda shorts and a small portion of the right side, namely the crotch area, is readily seen in FIG. 19. Hatched line 133 in FIG. 18 is an imaginary line for ease of understanding as is imaginary line 133'. Notice here that the hatching on 110 has been chosen to corrrespond to the hatching of FIG. 17 for ease of understanding. Here the dotted line designated 165 serves to both define the right edge of panel 115 and to serve as a seam line for the junction of the three (3) panels used in the construction of the front left portion of the garment. Other seam lines are seen to be sewn along the overlay of panels 110 and 115 between the points designated 166 and 166' and the points designated 166' and 167 to thereby form the front pocket. The sewing is completed by placing a seam along the line defined by points 164 and 164' and a seam along the line defined by points 168 and 169, the latter to join panel 130 to panel 120.

The next step in the formation of the garment would be to overlay panel 125 onto panel 120 and attach them to each other and to panel 130 in a manner similar to that previously described.

Of course it is seen that the belt line and waist seams have been not been discussed in detail since their creation would be readily understood by skilled artisans once they have familiarized themselves with the discussion supra.

While FIG. 19 is depicted as pertaining to shorts, it is to be understood that the five (5) panel construction just discussed is equally applicable to the preparation of slacks, especially if panel 130' is employed with the fly front, by adding the requisite tubular leg sections.

Figure 21:
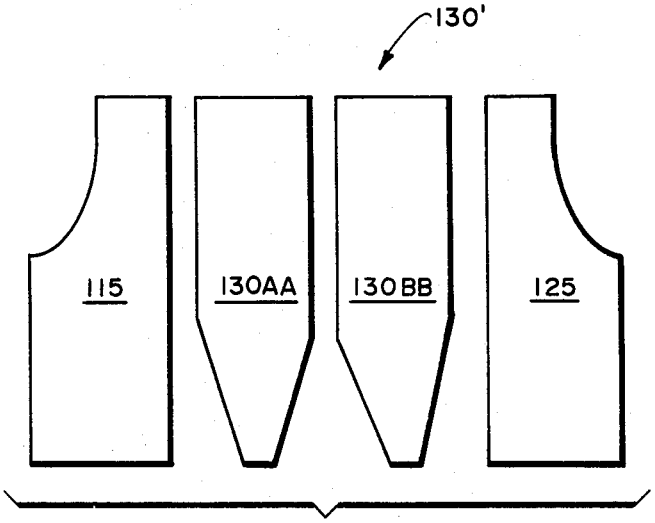
FIG. 21 is a front elevational view of the several panels employed in variant form of this invention.

A yet further mode of achieving the unique pants and crotch combination of this invention is illustrated in FIG. 21. Here six (6) panels are employed rather than five (5). Central panel 130 as shown in FIG. 18 is constituted as two (2) distinct central segments 130AA and 130BB. Quick reference to FIGS. 6 and 7 yields the fact that panel 21 is the same as panel 115 attached along one edge to 130AA. That is the central segments 130AA and 130BB are merely removed portions of the panels 21 and 13 as cut along imaginary dotted lines 68 and 70.

Some practitioners may find the use of this variant easier to handle as there is less fabric in any one panel. The effect of using a separate dual central panel system of FIG. 20 will still give rise to a sewn left side configured exactly as shown in FIG. 17.

In retrospect it is seen that the invention herein constitutes three (3) modes of achieving the same desired result, namely a new pants front structure having a front pocket and built in strain relief area at the crotch.

Each outer panel employed for the left and right whether formed from one (1) or two (2) pieces, constitutes a fabric section that in configuration as per FIG. 6 starts at a point A along a first side to a point at which the second side depends normally inwardly to a point at which it depends along a third edge normally upwardly to a lesser extent than the third side, then generally downwardly almost parallel to the third side to a point below the third edge, then inwardly again a distance less than the second edge to a point, then inclined outwardly and upwardly along a sixth edge to a point substantially in a horizontal plane with the commencement of the arcuately downward edge, at which the seventh edge goes upwardly to a point significantly above point A at which the eighth edge extends outwardly a distance approximately above the middle of the second edge, at which an edge corresponding to the pocket edge returns inclinededly or downwardly and arcuately as may be desired to point A.

The configuration of the inner panels of this invention is similar to those employed for the construction of the rear portion of the pants or shorts of this invention.

In the garment construction of the instant invention any type of cloth may be employed. Particularly flattering unisex pants can be had from fine and medium wale corduroy, especially when two complimentary colors are employed.

It will also be understood that the garment described herein may have its panels otherwise cut to achieve various styling effects and still be within the scope of this invention.

Since various changes may be made without departing from the spirit of the invention, the scope of which should be determined by the claims, the description herein should only be considered as as exemplary and not as limiting.

I claim:

1. In a garment formed from a plurality of flexible interconnected planar panels comprising:

a first panel being generally rectangular having a cut out section on the upper right corner thereof;

a second panel being a mirror image of said first panel, said first and second panels when interconnected forming the rear of said garment;

a third flexible panel comprising a first generally rectangular portion having a cut out section at the upper corner thereof, an elongated tapered section extending downwardly from the right side of said first rectangular portion integral therewith, the outer edge of said tapered section extending downwardly inwardly toward the central longtitudinal axis of said third panel, a second generally rectangular portion extending downwardly from the left side of said first rectangular portion integral therewith, the lower edge of said second rectangular portion terminating at a point above the lower edge of said tapered section, said second rectangular portion being spaced from said tapered section and separated therefrom;

a fourth panel in a mirror image of said third panel;

a fifth panel being generally rectangular having a cut out section at the upper right corner thereof, said third and fifth panels when interconnected forming the front left portion of said garment; and a sixth panel being a mirror image of said fifth panel, said fourth and sixth panels when interconnected forming the front right portion of said garment, with said front left portion and said front right portion, when interconnected, forming the front of said garment.

2. In the garment of claim 1 including first interconnecting means connecting the upper top edge of said third panel to the upper top edge of said fifth panel with said third panel overlying said fifth panel and exposing the upper left corner of said fifth panel, second interconnecting means connecting the left vertical edges of said third and fifth panels, third interconnecting means connecting the bottom horizontal edge of said second rectangular portion of said third panel to the left bottom horizontal edge of said fifth panel, fourth interconnecting means connecting the right vertical edge of the second rectangular portion of said third panel to a point along generally the longitudinal vertical axis of said fifth panel, said fourth interconnecting means also connecting said third panel to said fifth panel along generally the longitudinal vertical axis of each of said third and fifth panels, fifth inerconnecting means interconnecting the left vertical edge of said tapered section of said third panel to the outer edge of the cut out section of said fifth panel, the bottom horizontal edge of the tapered section of said third panel being connected to the right vertical edge of said fifth panel thereby forming said left front portion of said garment, said fourth and sixth panels being interconnected in like manner as said third and fifth panels thereby forming the right front portion of said garment, the right tapered edge of the tapered sections of each of said third and fourth panels being interconnected thereby forming the front portion of said garment.

3. In the garment of claim 2 wherein the right vertical edge of said first panel is interconnected to the left vertical edge of said second panel thereby forming the rear portion of said garment, the left vertical edge of said first panel being interconnected to one of the outer vertical interconnected edges of said first portion and the right vertical edge of said second panel being interconnected to the other outer vertical interconnected edges of said front portion, the edges of said cut out sections of each of said first and second panels being interconnected and the bottom horizontal edges of said first and second panels being interconnected to the bottom middle edges of said front portion thereby forming a completed garment having a pouch or flounce formed in the front portion.

4. In the garment of claim 1 wherein said cut out portions are arcuate cut outs.

5. In the garment of claim 1 wherein the tapered edge and the bottom edge of said tapered sections form an angle greater than 90 degrees.

6. In the garment of claim 1 wherein said third and fourth panels are formed from three separate panel sections, the first of said separate panel sections being generally rectangular with a cut out section at the upper left corner and the second of said separate panel sections being a mirror image of the first separate panel section, the third of said separate panel sections comprising an upper rectangular portion having a pair of downwardly tapered integral sections spaced from each other, the right vertical edge of said first separate panel section being connected to the left vertical edge of said third separate panel section and the left vertical edge of said second separate panel section being connected to the right vertical edge of said third separate panel section.

7. In a garment formed from a plurality of flexible interconnected planar panels comprising:

a first panel being generally rectangular having a cut out section in the upper right corner thereof;

a second panel being a mirror image of said first panel, said first and second panels when interconnected forming the rear of said garment;

a third flexible panel comprising a first generally rectangular portion having a first generally trapezoidally shaped portion integral therewith extending downwardly from the left bottom thereof having a cut out section on the left edge, and a second generally trapezoidally shaped portion integral therewith extending downwardly from the right bottom thereof having a cut out section on the right edge, thereby forming a generally triangular space between said trapezoidally shaped portions;

a fourth panel being generally rectangular and having a cut out section at the upper left portion thereof;

a fifth panel being a mirror image of said fourth panel;

a sixth panel being generally rectangular having a cut out section at the upper right corner thereof, said third, fourth and sixth panels when interconnected forming the left side of the front portion of said garment; and a seventh panel being a mirror image of said sixth panel, said third, fifth and seventh panels when interconnected forming the right side of the front portion of said garment.

8. In the garment of claim 7 including first interconnecting means interconnecting the right vertical edge of said fourth panel to the left vertical edge of said third panel, second interconnecting means interconnecting the left vertical edge of said fifth panel to the right vertical edge of said third panel, said interconnected third, fourth and fifth panels overlying said sixth and seventh panels such that said cut out section at the upper right of said fourth panel exposes the upper left portion of said sixth panel and the cut out section at the upper portion of said fifth panel exposes the upper right portion of said seventh panel, the upper edges of said third, fourth and fifth panels being interconnected to the upper edges of said sixth and seventh panels, the left generally vertical tapered edge of said first trapezoidally shaped portion being interconnected to the edge of the cut out section of said sixth panel and the left generally vertical tapered edge of said second trapezoidally shaped portion being interconnected to the edge of the cut out section of said seventh panel.

9. In the garment of claim 8 wherein the right vertical edge of said first panel is interconnected to the left vertical edge of said second panel thereby forming the rear portion of said garment, the left vertical edge of said first panel being interconnected to one of the outer vertical interconnected edges of said front portion and the right vertical edge of said second panel being interconnected to the other puter vertical interconnected edges of said front portion, the edges of said cut out sections of each of said first and second panels being interconnected and the bottom horizontal edges of said first and second panels being interconnected to the bottom middle edges of said front portion there forming a completed garment having a pouch or flounce formed the the front portion.

10. In the garment of claim 7 wherein said cut out portions are arcuate cut out portions.

11. In the garment of claim 7 wherein the right tapered edge and the bottom edge of said first trapezoidally shaped portion and the left tapered edge and the bottom edge of said second trapezoidally shaped portion form an angle greater than 90 degrees.

12. In the garment of claim 7 wherein said third flexible panel is comprised of a pair of interconnected panels, one of said last-mentioned panels including an upper rectangular portion having said first trapezoidally shaped portion at the bottom and the other of said last-mentioned panels including in upper rectangular portion having said second trapezoidally shaped portion at the bottom, said last mentioned panels being interconnected along the vertical right edge of the first of said pair of interconnected panels and the left vertical edge of the second of said pair of interconnected panels.

13. A method for forming a garment from flexible material including the steps of:

cutting a first rectangular panel from said material and cutting a section out of the upper right corner thereof;

cutting a mirror image of said first panel from said material;

cutting a third rectangular panel from said material;

cutting a section out of the upper left corner of said third panel;

cutting a tapered elongated section on the bottom right portion of said third panel and a rectangular portion on the lower left spaced from the tapered section;

cutting a fourth panel that is a mirror image of said third panel from said material;

cutting a fifth rectangular panel from said material and cutting a section out of the upper right corner thereof;

cutting a sixth panel from said material that is a mirror image of said fifth panel;

sewing together the upper top edges of said third and fifth panels with said third panel overlying said fifth panel and exposing the upper left corner of said fifth panel;

sewing the left vertical edges together of the third and fifth panels;

sewing the bottom horizontal edge of said third panel to the left bottom horizontal edge of the fifth panel;

sewing the right vertical edge of the third panel to a point along generally the vertical longitudinal axis of said fifth panel;

sewing the left vertical edge of the tapered section of the third panel to the outer edge of the cut out section of the fifth panel;

sewing the fourth and sixth panels in like manner as said aforementioned third and fifth panels thereby forming the front portion of the garment;

sewing the right vertical edge of the first panel to the left vertical edge of the second panel; and sewing the first panel to one of the outer vertical edges of the front portion of the garment and the second panel to the other outer vertical edge of the front portion.

* * * * *